US005755498A

United States Patent [19]

Cutler

[11] Patent Number: 5,755,498

[45] Date of Patent: May 26, 1998

[54] COMPACT SLIDING VANITY STEP SYSTEM

[76] Inventor: Nellie Lorraine Miller Cutler, 7114 S. 2825 East, Salt Lake City, Utah 84121

[21] Appl. No.: 762,283

[22] Filed: Dec. 9, 1996

[51] Int. Cl.[6] ..... A47B 83/00

[52] U.S. Cl. ..... 312/235.1; 312/278

[58] Field of Search ..... 312/235.1, 228, 312/235.3, 278; 182/88, 90, 39

[56] References Cited

U.S. PATENT DOCUMENTS

| | | | |
|---|---|---|---|
| 1,973,628 | 9/1934 | Hindle | 312/235.1 |
| 3,083,053 | 3/1963 | Dorsey | 312/235.1 X |
| 3,306,692 | 2/1967 | Timmerman | 312/235.3 X |
| 3,311,190 | 3/1967 | Naumann | 312/235.3 X |
| 3,481,429 | 12/1969 | Gaede | 312/235.1 X |
| 4,545,628 | 10/1985 | Richey | 312/235.1 |
| 5,005,667 | 4/1991 | Anderson | 182/88 X |
| 5,009,282 | 4/1991 | Willsher | 182/88 |
| 5,277,487 | 1/1994 | Simon | 312/228 X |
| 5,341,897 | 8/1994 | Gross | 312/235.1 X |

FOREIGN PATENT DOCUMENTS

| | | | |
|---|---|---|---|
| 889663 | 9/1930 | France | 312/235.1 |
| 5130920 | 5/1993 | Japan | 312/235.1 |
| 1227808 | 4/1971 | United Kingdom | 312/235.1 |

*Primary Examiner*—Peter M. Cuomo
*Assistant Examiner*—Janet M. Wilkens

[57] ABSTRACT

A new Compact Sliding Vanity Step System for providing a pull out step for a bathroom vanity wherein a child may stand upon the step instead of having to manipulate an unsafe object adjacent the vanity. The inventive device includes a step slidably projecting under a floor of a vanity cabinet by a combination of rails, and a support member secured to a bottom surface of the step for supporting an extended portion of the step during operation. The support member is normally slightly above a floor to allow sliding of the step and the support member without the support member catching upon the floor or a rug.

11 Claims, 3 Drawing Sheets

COMPACT SLIDING VANITY STEP SYSTEM

BACKGROUND OF THE INVENTION

1. Field of the Invention

The present invention relates to Vanity Devices and more particularly pertains to a new Compact Sliding Vanity Step System for providing a pull out step for a bathroom vanity wherein a child may stand upon the step instead of having to manipulate an unsafe object adjacent the vanity.

2. Description of the Prior Art

The use of Vanity Devices is known in the prior art. More specifically, Vanity Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Vanity Devices include U.S. Pat. No. 4,135,604; U.S. Pat. No. 5,094,515; U.S. Design Pat. No. 243,182; U.S. Pat. No. 5,238,300; U.S. Pat. 5,085,290 and U.S. Pat. No. 4,846,304.

While these devices fulfill their respective, particular objectives and requirements, the aforementioned patents do not disclose a new Compact Sliding Vanity Step System. The inventive device includes a step slidably projecting under a floor of a vanity cabinet by a combination of rails, and a support member secured to a bottom surface of the step for supporting an extended portion of the step during operation.

In these respects, the Compact Sliding Vanity Step System according to the present invention substantially departs from the conventional concepts and designs of the prior art, and in so doing provides an apparatus primarily developed for the purpose of providing a pull out step for a bathroom vanity wherein a child may stand upon the step instead of having to manipulate an unsafe object adjacent the vanity.

SUMMARY OF THE INVENTION

In view of the foregoing disadvantages inherent in the known types of Vanity Devices now present in the prior art, the present invention provides a new Compact Sliding Vanity Step System construction wherein the same can be utilized for providing a pull out step for a bathroom vanity wherein a child may stand upon the step instead of having to manipulate an unsafe object adjacent the vanity.

The general purpose of the present invention, which will be described subsequently in greater detail, is to provide a new Compact Sliding Vanity Step System apparatus and method which has many of the advantages of the Vanity Devices mentioned heretofore and many novel features that result in a new Compact Sliding Vanity Step System which is not anticipated, rendered obvious, suggested, or even implied by any of the prior art Vanity Devices, either alone or in any combination thereof.

To attain this, the present invention generally comprises a step slidably projecting under a floor of a vanity cabinet by a combination of rails, and a support member secured to a bottom surface of the step for supporting an extended portion of the step during operation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Compact Sliding Vanity Step System apparatus and method which has many of the advantages of the Vanity Devices mentioned heretofore and many novel features that result in a new Compact Sliding Vanity Step System which is not anticipated, rendered obvious, suggested, or even implied by any of the prior art Vanity Devices, either alone or in any combination thereof.

It is another object of the present invention to provide a new Compact Sliding Vanity Step System which may be easily and efficiently manufactured and marketed.

It is a further object of the present invention to provide a new Compact Sliding Vanity Step System which is of a durable and reliable construction.

An even further object of the present invention is to provide a new Compact Sliding Vanity Step System which is susceptible of a low cost of manufacture with regard to both materials and labor, and which accordingly is then susceptible of low prices of sale to the consuming public, thereby making such Compact Sliding Vanity Step System economically available to the buying public.

Still yet another object of the present invention is to provide a new Compact Sliding Vanity Step System which provides in the apparatuses and methods of the prior art some of the advantages thereof, while simultaneously overcoming some of the disadvantages normally associated therewith.

Still another object of the present invention is to provide a new Compact Sliding Vanity Step System for providing a pull out step for a bathroom vanity wherein a child may stand upon the step instead of having to manipulate an unsafe object adjacent the vanity.

Yet another object of the present invention is to provide a new Compact Sliding Vanity Step System which includes a step slidably projecting under a floor of a vanity cabinet by a combination of rails, and a support member secured to a bottom surface of the step for supporting an extended portion of the step during operation.

Still yet another object of the present invention is to provide a new Compact Sliding Vanity Step System that is capable of being installed into an existing vanity cabinet.

Even still another object of the present invention is to provide a new Compact Sliding Vanity Step System that allows a child to reach a sink within the vanity cabinet safely and conveniently.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
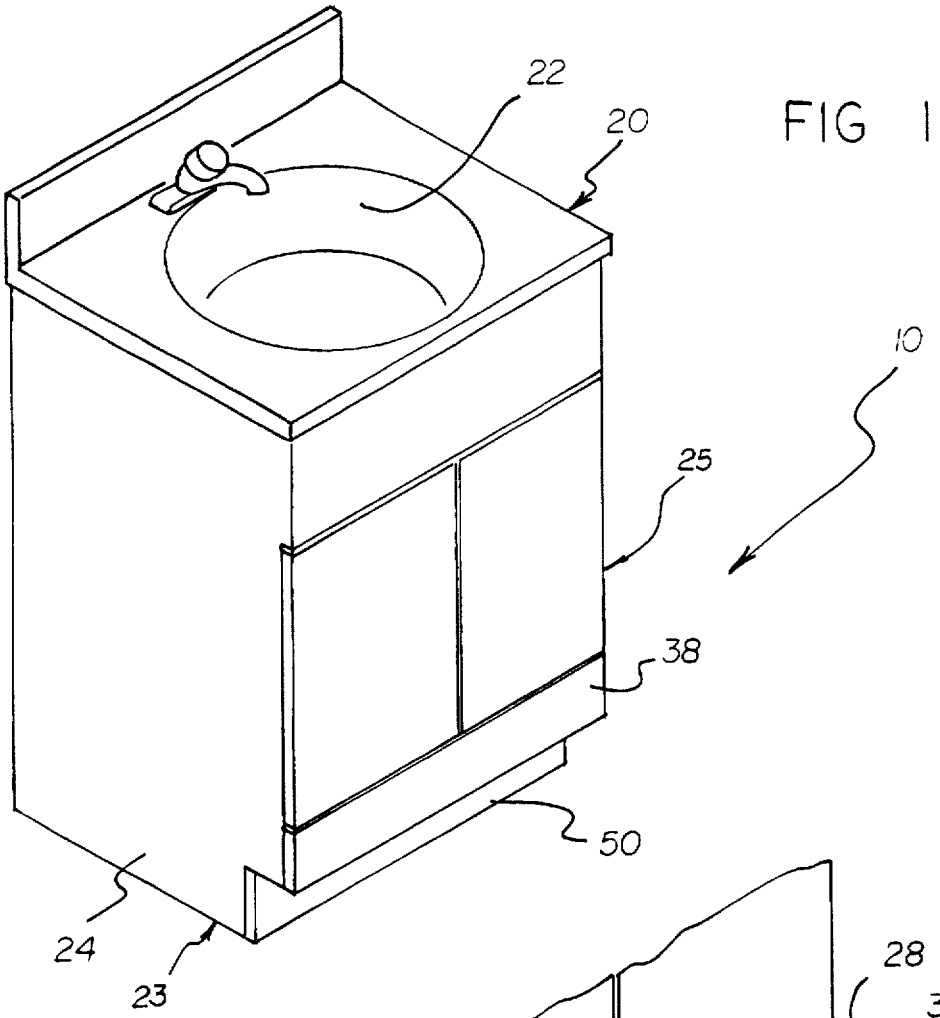
FIG. 1 is an upper perspective view of a new Compact Sliding Vanity Step System according to present invention.

With reference now to the drawings, and in particular to FIGS. 1 through 6 thereof, a new Compact Sliding Vanity Step System embodying the principles and concepts of the present invention and generally designated by the reference numeral 10 will be described.

More specifically, it will be noted that the Compact Sliding Vanity Step System 10 comprises a step 30 removably projecting into a vanity cabinet 20 beneath a bottom panel 28 within the vanity cabinet 20, and a sliding means 40 secured mesial the step 30 and the vanity cabinet 20 for allowing the step 30 to slide from within the vanity cabinet 20 for allowing a child to stand upon the step 30 to reach a sink 22 within the bathroom vanity.

The cabinet 20 is of the type having a lower base portion 23 and an upper storage portion 25. The front of the upper storage portion projecting out beyond the front of the lower base portion 23 such that a kick recess is formed under the projection of the upper storage portion 25.

As shown in FIGS. 1 through 6 of the drawings, a support member 50 is secured orthogonally to a bottom surface of the step 30 for supporting an extended portion of the step 30 during utilization. The support member 50 is preferably normally a distance, approximately ⅛ of an inch, above an unnumbered floor for preventing catching of the step 30 upon the unnumbered floor or an unnumbered object on the unnumbered floor.

Figure 6:
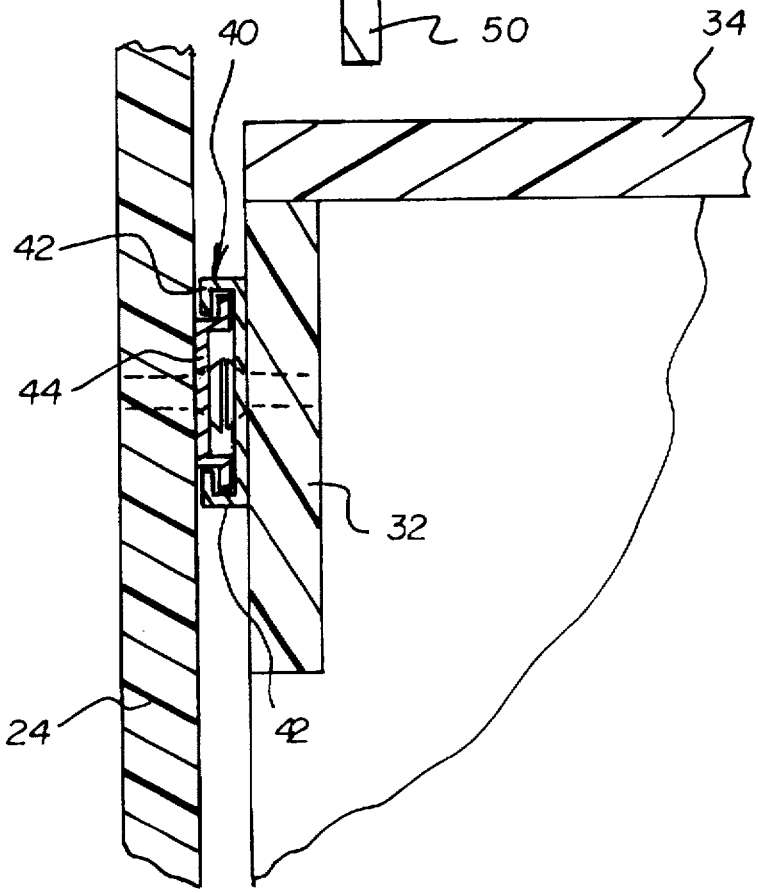
FIG. 6 is a cross sectional view taken along line 6—6 of FIG. 3.

As shown in FIGS. 2 through 6 of the drawings, the sliding means 40 comprises a first inner rail 44 parallel to the unnumbered floor secured to a first wall 24 of the vanity cabinet 20. A first outer rail 42 is secured to the step 30 and slidably engages the first inner rail 44 as best shown in FIG. 6 of the drawings. A second inner rail 48 parallel to the unnumbered floor is secured to a second wall 26 of the vanity cabinet 20. A second outer rail 46 is secured to the step 30 opposite of the first outer rail 42 and slidably engages the first inner rail 44.

Figure 2:
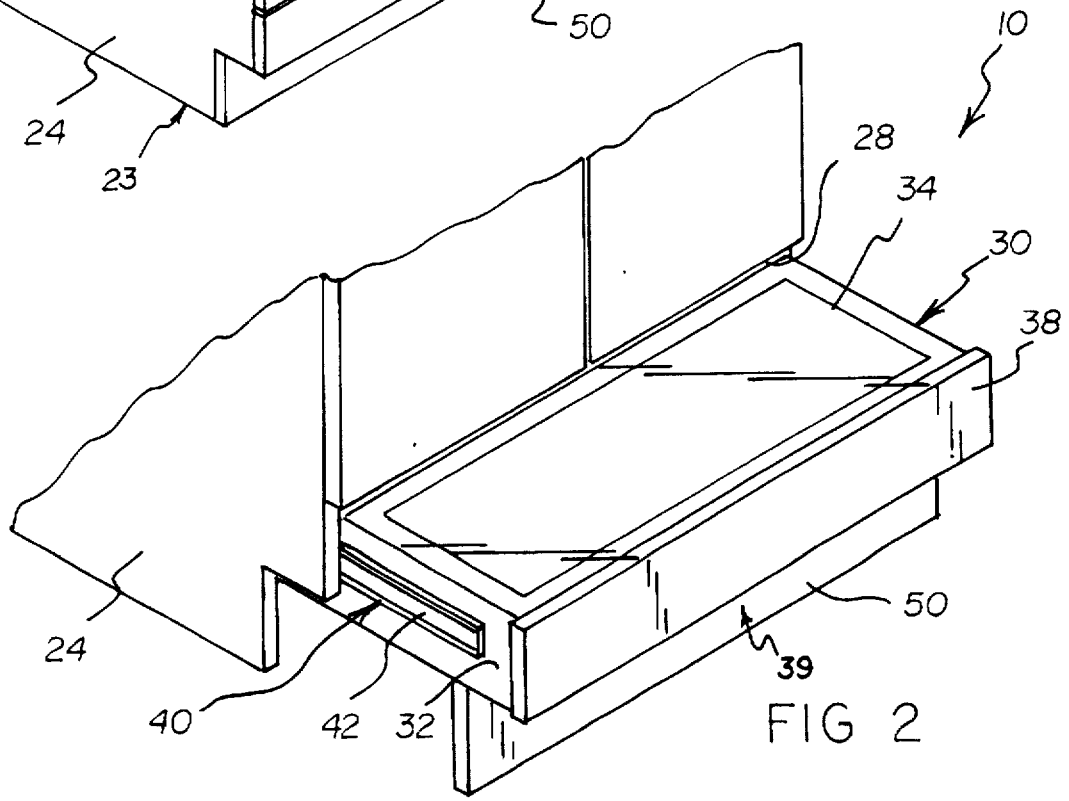
FIG. 2 is an upper perspective view of the present invention extended from within a vanity cabinet.
Figure 3:
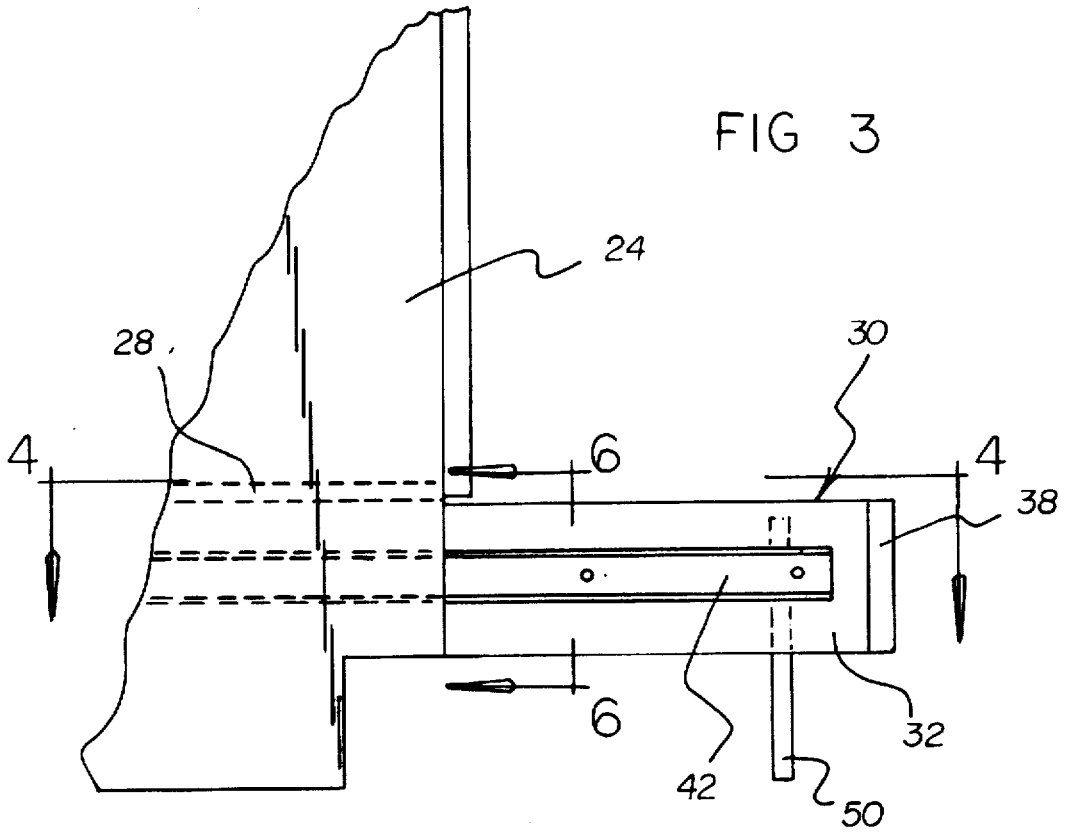
FIG. 3 is a side view of the present invention.
Figure 4:
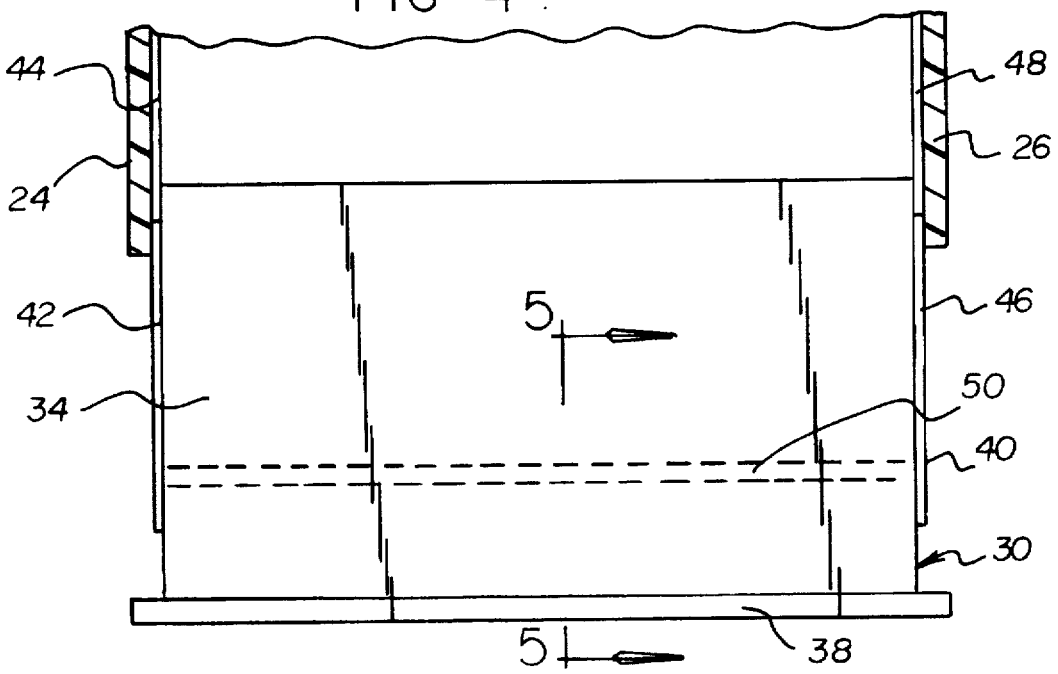
FIG. 4 is a cross sectional view taken along line 4—4 of FIG. 3.
Figure 5:
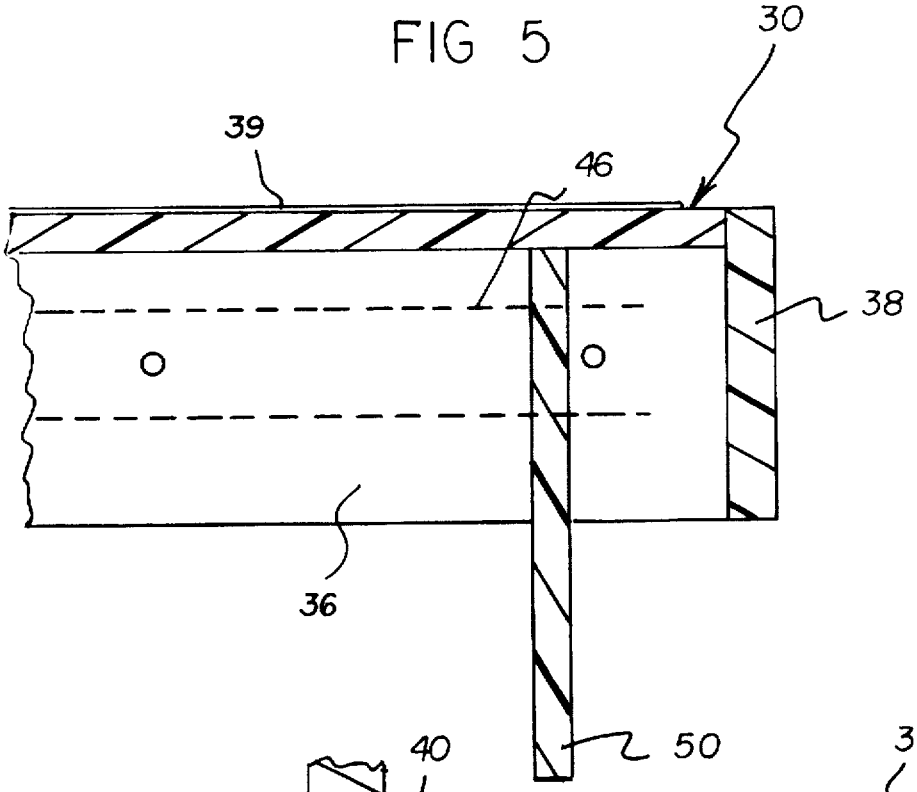
FIG. 5 is a cross sectional view taken along line 5—5 of FIG. 4.

As shown in FIGS. 1 through 6 of the drawings, the step 30 comprises a top member 34 substantially swaged for receiving a foot of the child. A left member 32 is secured orthogonally to an edge of the top member 34 as best shown in FIG. 2 of the drawings. The left member 32 secures the first outer rail 42. A right member 36 is secured orthogonally to the top member 34 opposite of the left member 32. The right member 36 secures the second outer rail 46 as shown in FIG. 4 of the drawings. A front member 38 is secured orthogonally to the top member 34 mesial the left member 32 and the right member 36. The front member 38 having a bottom edge positioned proximate the kick recess to form a handle 48. Preferably, a non-slip surface 39 is secured onto the top member 34 for preventing slippage of the child during utilization.

In use, the child pulls the step 30 from within the lower portion of the vanity cabinet 20. The support member 50 is high enough above the unnumbered floor for preventing catching upon the floor or an object. The child steps upon the top member 34 whereby the support member 50 engages the unnumbered floor because of a slight bending downward of the step 30 in relation to the vanity cabinet 20. The child is thereafter able to reach the sink 22 without having to utilize an unsafe object which could cause injury to the child by slipping out from under the child. When the child is finished utilizing the vanity cabinet 20, the child pushes the step 30 back into the vanity cabinet 20 where it assimilates into the appearance of a conventional vanity cabinet. The storage of the step 30 within the lower portion of the vanity cabinet 20 beneath the bottom panel 28 allows utilization of the complete interior storage space of the vanity cabinet 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A compact sliding cabinet step system for mounting on a cabinet of the type having a front and a rear and comprising a lower base portion, the lower base portion having a bottom edge, the bottom edge being for resting on a floor surface, the cabinet further being of the type having an upper storage portion positioned above said lower base portion, the front of said lower base portion of said cabinet being recessed inward from the front of said upper storage portion of said cabinet such that a kick recess is formed in the front of the cabinet, said kick recess of said cabinet having a vertical height substantially equal to the distance between the upper storage portion and the floor surface upon which said lower base portion is rested, said system comprising:

a step adapted for slidably mounting in the upper storage portion of the cabinet adjacent to the lower base portion of said cabinet, said step including:

sliding means for securing said step in the upper storage portion of the cabinet, said sliding means being adapted to permit said step to be forwardly slidable outward from the front of the upper storage portion of the cabinet to a deployed position and to be rearwardly slidable from said deployed position to a stored position in the upper storage portion of the cabinet, said step being adapted such that said step is spaced above the bottom edge of the lower base portion a distance that is substantially equal to the vertical height of the kick recess of the cabinet, and said step including a step support member extending downwardly from the step, said step support member being adapted for contacting the floor surface upon which the bottom edge of the lower base portion of the cabinet is rested, said step support member being adapted such that the member has a vertical height above the bottom edge greater than the vertical height of said kick recess, said step support member being adapted such that the step support member is spaced rearwardly from the front of said step such that said step support member is located substantially adjacent to the front of the lower base portion of the cabinet when said step is in said stored position so as not to obstruct the kick recess of the cabinet in which said step is mounted.

2. The compact sliding cabinet step system of claim 1 wherein the step is adapted such that the distance said step is spaced above the bottom edge of the lower base by said step support member is substantially equal to the distance that said step support member is spaced rearwardly from the front of the upper storage portion of the cabinet upon which the step is mounted.

3. The compact sliding cabinet step system of claim 1 wherein said sliding means comprises:

a first inner rail being adapted for orienting parallel to the lower base portion of the cabinet and further being adapted for securing to a first wall of the cabinet;

a first outer rail secured to said step and slidably engaging said first inner rail;

a second inner rail being adapted for orienting parallel to the lower base portion of the cabinet and further being adapted for securing to a second wall of the cabinet; and a second outer rail secured to said step opposite of said first outer rail and slidably engaging said second inner rail.

4. The compact sliding cabinet step system of claim 1 wherein said step comprises:

a top planar member;

a left side member secured substantially orthogonally to an edge of said top planer member for mounting said first outer rail;

a right side member secured substantially orthogonally to an edge of said top planar member opposite of said left side member for mounting said second outer rail; and a front member secured substantially orthogonally to said top planar member and having a bottom edge for locating adjacent to and above the kick recess of a cabinet to form a handle for pulling said step from the stored position.

5. The compact sliding cabinet step system of claim 1 wherein said step has an upper surface, and additionally including a non-slip surface secured to the upper surface of said step for preventing slippage of of a foot placed upon said step.

6. In combination:

a cabinet having a front and a rear, said cabinet comprising a lower base portion being adapted for resting on a floor surface and an upper storage portion positioned above said lower base portion, the front of said lower base portion of said cabinet being recessed inward from the front of said upper storage portion of said cabinet such that a kick recess is formed in the front of the cabinet, said kick recess being adapted such that the recess has a vertical height substantially equal to the distance between the upper storage portion and the floor surface upon which said lower base portion is rested;

a step slidably mounted in the upper storage portion of said cabinet adjacent to the lower base portion, said step having a deployed position and a stored position, said step being forwardly slidable outward from the front of the upper storage portion of said cabinet to said deployed position in front of said cabinet and being rearwardly slidable from said deployed position to said stored position in the upper storage portion of said cabinet, said step being adapted such that the step is spaced above the floor surface upon which said lower base portion is rested a distance that is substantially equal to the vertical height of said kick recess, said step including a step support member extending downwardly from the step, said step support member being adapted for contacting the floor surface upon which said lower base portion is rested, said step support member being spaced rearwardly from the front of said step such that said support member is located substantially adjacent to the front of said lower base portion when said step is in said stored position so as not to obstruct said kick recess.

7. The combination of claim 6 wherein the step is adapted such that the said distance that said step is spaced above the floor surface by said step support member is substantially equal to the distance that said step support member is spaced rearwardly from the front of the upper storage portion of said cabinet.

8. The combination of claim 6 wherein said step has an upper surface for being stood upon, wherein the vertical distance between said upper surface of said step and a bottom edge of said lower base portion is at least about twice the vertical height of said kick recess.

9. The combination of claim 6 wherein said step has a substantially flat upper surface for being stepped on by a user when said step is in said deployed position.

10. The combination of claim 6 wherein said step support member extends substantially the entire length of the front of said cabinet.

11. In combination:

a cabinet having a front and a rear, said cabinet comprising a lower base portion being adapted for resting on a floor surface and an upper storage portion positioned above said lower base portion, the front of said lower base portion of said cabinet being recessed inward from the front of said upper storage portion of said cabinet such that a kick recess is formed in the front of the cabinet, said kick recess being adapted such that the recess has a vertical height substantially equal to the distance between the upper storage portion and the floor surface upon which said lower base portion is rested;

a step slidably mounted in the upper storage portion of said cabinet adjacent to the lower base portion, said step having a deployed position and a stored position, said step being forwardly slidable outward from the front of the upper storage portion of said cabinet to said deployed position in front of said cabinet and being rearwardly slidable from said deployed position to said stored position in the upper storage portion of said cabinet, said step being adapted such that step is spaced above the floor surface upon which said lower base portion is rested a distance that is substantially equal to the vertical height of said kick recess, said step including a step support member extending downwardly from the step, said step support member being adapted for contacting the floor surface upon which said lower base portion is rested, said step support member being spaced rearwardly from the front of said step such that said support member is located substantially adjacent to the front of said lower base portion when said step is in said stored position so as not to obstruct said kick recess;

wherein the distance that said step is spaced above a bottom edge of the lower base portion of the cabinet by said step support member is substantially equal to the distance that said step support member is spaced rearwardly from the front of the upper storage portion of said cabinet;

wherein said step has a substantially flat upper surface for being stood upon, wherein the vertical distance between said upper surface of said step and the bottom edge of the lower base portion of the cabinet is at least about twice the vertical height of said kick recess; and wherein said step support member extends substantially the entire length of the front of said cabinet.

* * * * *